US005996518A

United States Patent [19]

Tomita

[11] Patent Number: 5,996,518

[45] Date of Patent: Dec. 7, 1999

[54] SEWING MACHINE WITH WARNING SCREEN DISPLAYING FUNCTION

[75] Inventor: Shintaro Tomita, Nagoya, Japan

[73] Assignee: Brother Kogyo Kabushiki Kaisha, Toyota, Japan

[21] Appl. No.: 09/161,996

[22] Filed: Sep. 29, 1998

[30] Foreign Application Priority Data

Sep. 30, 1997 [JP] Japan ..... 9-267421

[51] Int. Cl.[6] ..... D05B 19/02; D05C 5/06

[52] U.S. Cl. ..... 112/470.01; 112/102.5; 112/445

[58] Field of Search ..... 112/470.01, 470.04, 112/470.06, 102.5, 445, 456, 458, 277

[56] References Cited

U.S. PATENT DOCUMENTS 4,416,208 11/1983 Nufer .
4,498,078 2/1985 Yoshimura et al. .
4,869,188 9/1989 Hyodo ..... 112/445
5,078,067 1/1992 Nakashima .
5,228,403 7/1993 Sugimoto ..... 112/277 X

FOREIGN PATENT DOCUMENTS 57-145372 U 9/1982 Japan .
2-60-17554 5/1985 Japan .
9-70487 3/1997 Japan .

*Primary Examiner*—Peter Nerbun
*Attorney, Agent, or Firm*—Oliff & Berridge, PLC

[57] ABSTRACT

A sewing machine is provided with an LCD capable of displaying color images. Sensors are provided to detect operational conditions of the sewing machine. A CPU controls a display to notify a user of the detected operational condition through changing, according to the detected results, the background color of a warning screen that includes a symbol display region and a message display region.

20 Claims, 13 Drawing Sheets

SEWING MACHINE WITH WARNING SCREEN DISPLAYING FUNCTION

BACKGROUND OF THE INVENTION

1. Field of the Invention

The present invention relates to a sewing machine.

2. Description of Related Art

There has been conventionally proposed a sewing device of a type that is provided with a sensor for automatically detecting an operational state of the sewing device. For example, there has been proposed an embroidery sewing machine that is provided with a sensor for detecting an operational state of the sewing machine. The operational state of the sewing device is defined by operational conditions of various parts in the sewing machine and various operations manipulated by a user onto the sewing machine.

The sewing machine is previously stored with data of a program for producing predetermined warning messages or alarm sounds for indicating that abnormal operational states are detected. The sewing machine is provided with a monochromatic liquid crystal display (LCD) capable of displaying the warning messages. Alternatively, the sewing machine is provided with a buzzer for producing alarm sounds.

With this structure, when the sensor detects some abnormal operational state, the monochromatic liquid crystal display is controlled by the program to display a warning message predetermined for the detected operational state. Or, the buzzer is controlled to produce an alarm sound. The user of the sewing machine in notified that the sewing device is presently in that abnormal state.

SUMMARY OF THE INVENTION

It is noted that there are various levels or ranks for the abnormal operational states. Some abnormal states will have considerably undesirable effects on the sewing process. The user should be strongly warned so that the user will urgently correct those undesirable operational states. Some other abnormal states will not have so much affect on the sewing process. When the detected operational state is such a trivial one, it is sufficient that the sewing machine simply call the user's attention to the present operational state.

The above-described predetermined warning messages and alarm sounds, however, fail to show whether or not the detected abnormal state is severe. Accordingly, the user may not know whether the present operational state will have great influences on the sewing processes. The user only knows that the detected abnormal condition presently occurs, but does not know how severe the present condition is. Accordingly, even when the present status is a very serious one, the user will possibly ignore the warning and will continue controlling the sewing machine under the present condition. This will result in a failure in sewing, and will possibly result in damaging the sewing machine. On the other hand, if the present condition is a relatively trivial one, the condition can be corrected easily if the user performs a proper fixing operation immediately after being warned. However, without knowing this fact, the user may still possibly ignore the warning and continue the sewing operation without performing the fixing operation. As the sewing operation continues, the condition will become worse. After the condition worsens the user will have to perform his/her fixing operation, which may be much more troublesome than that required to be performed immediately after being notified. It will take a longer period of time and much more load than when performing the fixing operation just after being notified.

It is further noted that the display is controlled to show other several types of information and messages under its normal operational state. Those several types of messages are displayed in the form of character strings, for example. The above-described warning messages are displayed also in the form of character strings. Accordingly, the user has to carefully read each displayed message before finally understanding the contents of the warning message.

The display, provided to the conventional sewing device, is of the monochromatic type. Accordingly, even when there occurs a very serious problem that has to be corrected very urgently, the display still shows the corresponding warning message in the form of black or white character strings. The user cannot understand the seriousness of the present condition intuitively or immediately.

Other problems arise when the buzzer is used to produce the warning sound. If the sewing machine is located at a noisy place, the user cannot hear the sound when he/she is away from the sewing device. Similarly, if a plurality of similar sewing machines are located next to one another in a single room, the user cannot know which of the sewing machines produces the warning sound. Additionally, if the user misses the warning sound, the user may never know this warning, and may fail to correct the present condition.

The present invention is attained to solve the above-described problems and to provide an improved sewing device that can immediately and properly notify the user of the present operational state of the sewing device, inclusive of the abnormal conditions and the user's performed erroneous operation, thereby enabling the user to perform proper correcting operations onto the sewing processes.

In order to attain the above and other objects, the present invention provides a sewing device, comprising: sewing means for performing a sewing operation; color display means capable of displaying a color image; judging means for judging an operational state of the sewing means; and notification control means for controlling the color display means to change a color displayed thereon, thereby notifying a user of the judged operational state.

The judging means may preferably include detection means for detecting an operational state of the sewing means, the notification control means controlling the color display means to change a color displayed thereon, thereby notifying a user of the detected operational state.

The color display means may have a display screen for displaying the color image thereon, and wherein the notification control means controls the color display means to change a background color displayed on the display screen, thereby notifying the user of the detected operational state. The detection means may include determination means for determining whether the detected operational state is either one of a predetermined plurality of different levels. The sewing machine may further comprise storage means for storing data of a predetermined plurality of different colors in one to one correspondence with the plurality of levels, the notification control means controlling the color display means to display one color predetermined for the determined level, thereby notifying the user of the detected operational state.

According to another aspect, the present invention provides a Sewing device, comprising: a sewing unit performing a sewing operation; a color display capable of displaying a color image; a judging unit judging an operational state of the sewing unit; and a notification controller controlling the color display to change a color displayed thereon, thereby notifying a user of the judged operational state.

BRIEF DESCRIPTION OF DRAWINGS

The above and other objects, features and advantages of the invention will become more apparent from reading the following description of the preferred embodiment taken in connection with the accompanying drawings in which:

FIG. 5(*b*) illustrates how a warning screen WS is displayed as a pop up menu over the operation screen OS of FIG. 5(*a*);

FIG. 7(*b*) shows one example of another warning screen WS-B indicative of a waiting state B;

FIG. 7(*c*) shows one example of a further warning screen WS-C indicative of an attention state C;

FIG. 7(*d*) shows one example of still another warning screen WS-D indicative of a warning state D;

FIG. 7(*e*) shows one example of still another warning screen WS-E indicative of a dangerous state E;

FIG. 8(*b*) shows structure of data stored in the ROM;

DETAILED DESCRIPTION OF THE PREFERRED EMBODIMENT

An embroidery sewing machine according to a preferred embodiment of the present invention will be described while referring to the accompanying drawings.

The sewing machine of the present embodiment is of a type that electronically performs information processings to select a pattern desired to be sewn and that automatically sews the selected pattern.

The structure of the embroidery sewing machine 1 of the present embodiment will first be described below with reference to FIGS. 1–8(*b*).

Figure 1:
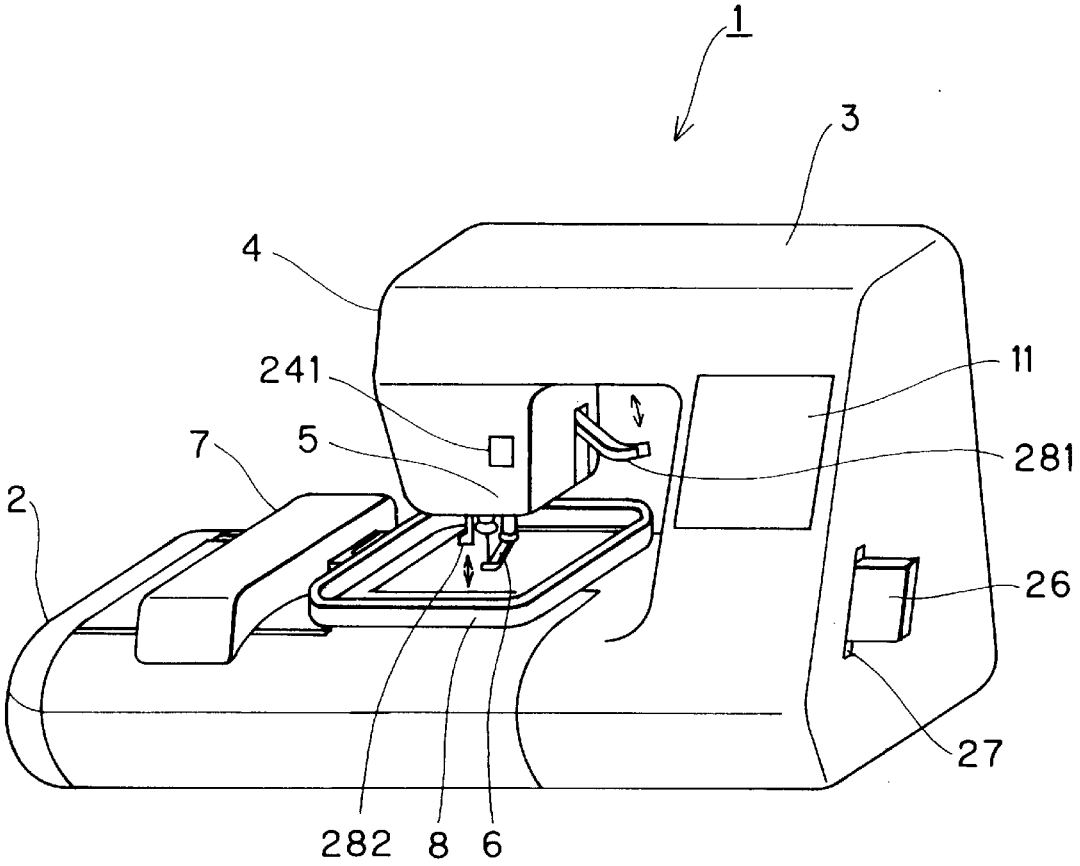
FIG. 1 illustrates a sewing machine according to an embodiment of the present invention.

As shown in FIG. 1, the embroidery sewing machine 1 has a bed section 2 in the form of a rectangular box, and an arm section 3 provided integrally on and extending leftwardly from a right upper portion of the bed section 2. A head 4 is formed at a left portion of the am section 3. and a needle bar 5 is provided at a lower portion of the head 4 and extends downwardly. A sewing needle 6 is attached to a lower end of the needle bar 5. A horizontally rotating shuttle (not shown) for cooperating with the sewing needle 6 to form stitches is provided inside the bed section 2. An embroidery frame 8 is disposed above the bed section 2. The embroidery frame 8 is for supporting a workpiece cloth in which embroidery is desired to be sewn. A horizontal movement mechanism 7 is provided also above the bed section 2 to move the embroidery frame 8. A sewing machine motor 291 (shown in FIG. 2) is disposed in the bed section 2 for driving the needle bar 5, the horizontally rotating shuttle, and the horizontal movement mechanism 7.

A card reading device 27 is provided in the arm section 3. An external memory card 26 can be mounted in the card reading device 27. The external ROM card 26 stores therein data of a plurality of embroidery patterns to be sewn. The card reading device 27 is for retrieving a user's selected embroidery pattern data from the memory card 26. With the retrieved embroidery pattern data, sewing operation is performed to control the horizontal movement mechanism 7 to move the embroidery frame 8 to desired positions and to control the sewing needle bar 5 and the horizontally rotating shuttle (not shown) to sew the selected embroidery pattern onto the workpiece cloth in the embroidery frame 8.

A starting/stopping switch 241 is provided on a front surface of the head section 4 for starting or stopping the sewing machine motor 291. A presser foot lever 281 is provided on a side surface of the head section 4. The presser foot lever (FL) 281 can be set in its upper and lower predetermined positions. The presser foot lever 281 has to be located in the lower predetermined position when sewing a linear stitch. A button hole lever (BL) 282 is provided on an under surface of the head section 4. The button hole lever 282 can be set in its upper and lower predetermined positions. The button hole lever 282 has to be located in the lower predetermined position when sewing a button hole. The button hole lever 282 has to be located in the upper predetermined position when sewing a straight stitch.

Figure 3:
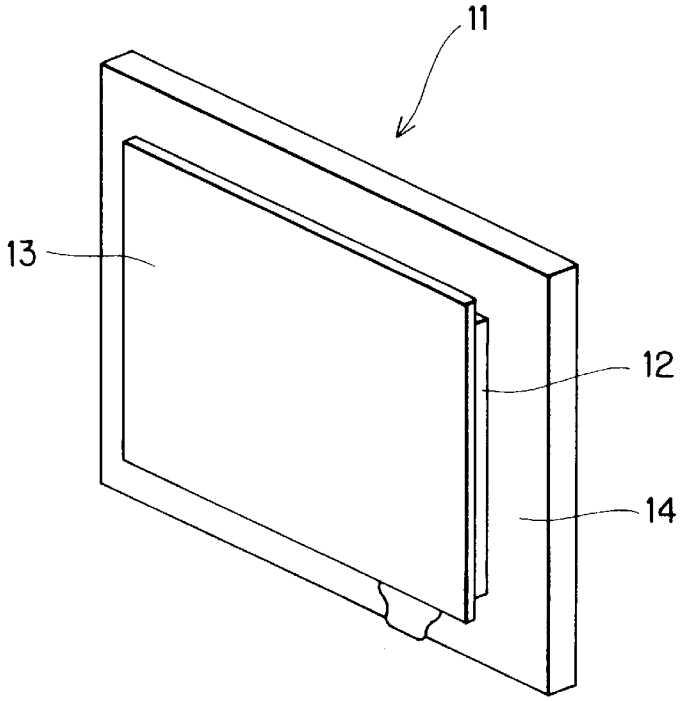
FIG. 3 illustrates a display device provided to the sewing machine.
Figure 5A:
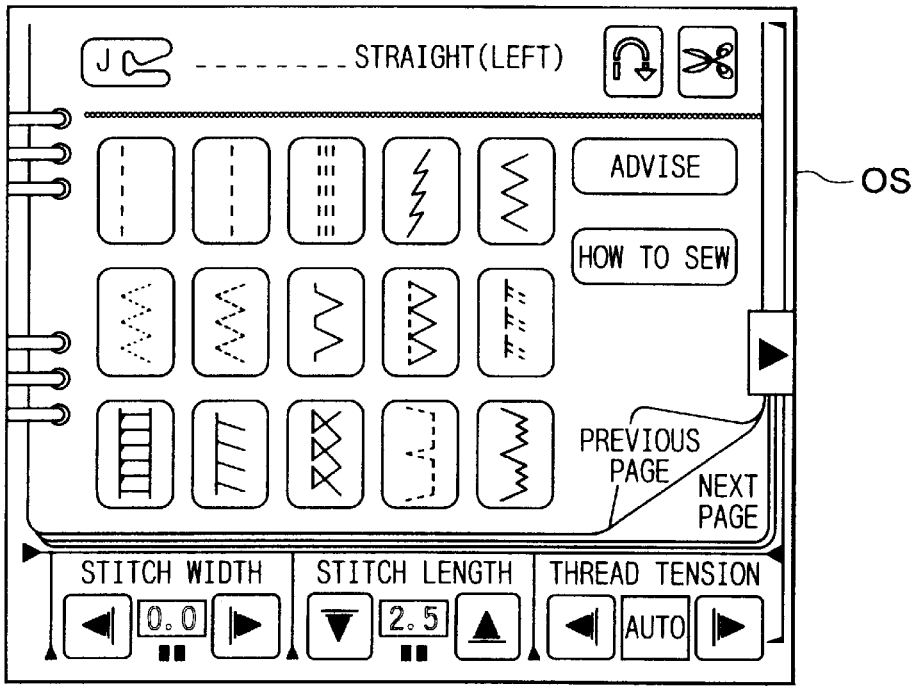
FIG. 5(*a*) illustrates an example of an operation screen OS displayed on the display device of FIG. 3.
Figure 5B:
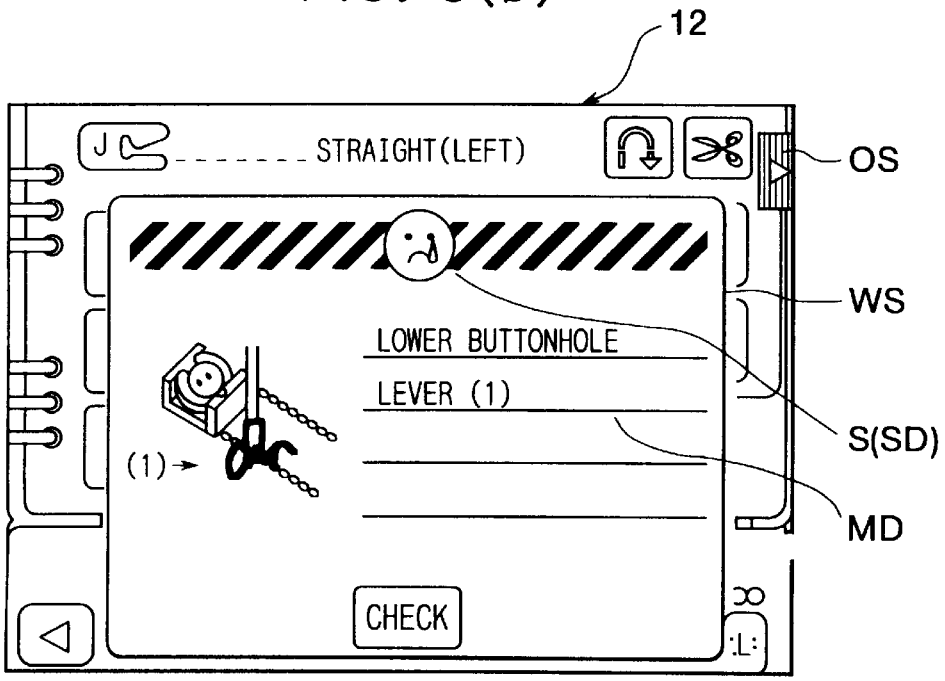

The embroidery sewing machine 1 further has a display device 11 at a front face portion of an upright position of the arm section 3. The display device 11 is in the form of a combination structure of a touch panel 13 and a color liquid crystal display 12 (FIG. 3). The display device 11 serves to display an operation screen OS. such as a pattern selection screen as shown in FIG. 5(*a*), while enabling the user to input his/her operation command, such as a pattern selection command, to the sewing machine 1. The display device 11 further serves to display a warning screen WS over the operation screen OS as shown in FIG. 5(*b*).

With the above-described structure, the sewing machine 1 shows the pattern selection screen OS on the display device 11 to enable the user to select one stitch pattern desired to be sewn. The sewing machine 1 then retrieves stitch data for the user's selected pattern from the memory card 26 via the card reading device 27, and automatically saws the user's selected embroidery on a workplace through moving the needle 6 and the embroidery frame 8 relative to each other.

The display device 11 will be described below in greater detail.

As shown in FIG. 3. the display device 11 includes the liquid crystal display (LCD) 12 for displaying characters, figures, symbols, and the like. A touch panel 13 is located over and in front of the LCD 12. The touch panel 13 is for enabling the user to access the contents of information displayed on the LCD 12 and to input his/her desired commands. A control panel 14 is provided in the rear side of the LCD 12. The control panel 14 is for judging the commands inputted via the touch panel 13 and for performing calculation processing to display necessary information on the LCD 12. The control panel 14 is also for controlling the entire sewing machine 1.

The LCD 12 is of a color type that is capable of displaying a color image. More specifically, the LCD 12 includes an RGB color filter (not shown) to reproduce, for each of a plurality of dots, a color based on red, green, and blue color components. The LCD 12 can therefore display a plurality of colors.

As shown in FIG. 5(*a*), the LCD 12 can display an operation screen OS to enable a user to perform various inputting operations in the course of the sewing operation. For example, the LCD 12 displays the pattern selection screen OS to enable the user to select one of a plurality of embroidery patterns to sew.

The LCD 12 can also display the warning screen WS as shown in FIG. 5(*b*) as a pop up screen displayed over the operation screen OS. The warning screen WS is for showing the present operational state of the sewing machine 1 together with a danger degree that shows how the present operational state is dangerous with regards to sewing operation. The LCD 12 displays the warning screen WS when it is necessary to instruct the user of the operational state.

As shown in FIG. 5(*b*), the entire area of the warning screen WS is capable of showing a single background color of either one of at least four predetermined different colors: blue, yellow, orange, and red. The background color of the warning screen WS is adjusted to directly show the danger degree of the operational state of the sewing machine 1. That is, when the operational state is normal, the background color is blue. When the operational state becomes slightly abnormal and therefore the user has to pay attention to the operational state to correct the operational state, the background color is adjusted to yellow. This operational state will be referred to as "attention state C" hereinafter. When the operational state becomes more severe and the user has to be warned to correct the operational state, the background color is adjusted to orange. This operational state will be referred to as "warning state D" hereinafter. In this example, when the attention state C is not corrected by the operator, the operational state is judged to become more severe and to reach the warning state D. When the operational state becomes fully dangerous, the background color is adjusted to red. This operational state will be referred to as "dangerous state E" hereinafter. Thus, according to the present embodiment, the background of the warning screen WS is controlled to change in color according to the danger degree of the operational state. That is, the background color is blue in the normal state. The background color changes from yellow through orange to red in the abnormal states as the danger degree increases from the state C (lowest level) through the state D (middle level) to the state E (highest level). With this arrangement, the user can know the danger degree of the present operational state at a glance of the warning screen WS.

As shown in FIG. 5(*b*), the warning screen WS includes a symbol display region SD and a message display region MD. Both of the symbol display region SD and the message display region MD are formed over the single background color of the warning screen WS. The message display region MD is for displaying a message, constructed from character strings and figures, for indicating the present operational state and for instructing the user to perform necessary operations.

The symbol display region SD is for displaying a symbol indicative of the dangerous degree of the operational state. More specifically, the symbol display region SD displays either one of five different symbols S (S-A through S-E) shown in FIG. 6. Each of the different symbols S-A through S-E indicates expression of a single imaginary person's face. Both of the happy face S-A and the normal face S-B show that the present operational state is normal, and therefore are displayed on the blue background. The happy face S-A shows a correct operational state A where the sewing machine 1 is presently performing a correct operation. The normal face SB shows a waiting state B where the sewing machine 1 is presently waiting for the user's next operation. The sad face S-C shows that the present operational state is the attention state C, and therefore is displayed on the yellow background. The crying face S-D shows that the present operational state is the warning state D, and therefore is displayed on the orange background. The angry face S-E shows that the present operational state is the dangerous state E, and therefore is displayed on the red background. With this structure, the user can easily know the danger degree of the present operational state through viewing the combination of the symbol S and the background color of the warning screen WS.

Thus, according to the present embodiment, the display device 11 can display a plurality of warning screens WS for a plurality of operational states predetermined for the sewing machine 1. The warning screens WS are categorized into five types of warning screens WS-A, WS-B, WS-C, WS-D, and WS-E for the five different operational states A through E. respectively.

FIG. 7(*a*) shows one example of the warning screen WS-A. The warning screen WS-A has the blue background and symbol SA (happy face). The warning screen WS-A is displayed when the sewing machine 1 is operating properly in response to the user's proper manipulation (correct operational state A).

FIG. 7(*b*) shows one example of the warning screen WS-B. The warning screen WS-B has the blue background and symbol SB (normal face). This warning screen VS-B is displayed when the sewing machine 1 waits for the user's next operation (waiting state B).

FIG. 7(*c*) shows one example of the warning screen WS-C. The warning screen WS-C has the yellow background and has symbol S-C (gad face). This warning screen WS-C is displayed when the user performs an abnormal or erroneous operation onto the sewing machine 1 or when the sewing machine 1 is in an abnormal condition that is incapable of performing its normal operation (attention state C).

FIG. 7(*d*) shows one example of the warning screen WS-D. The warning screen WS-D has the orange background and has symbol S-D (crying face). The warning screen WS-D is displayed after the warning screen WS-C if the user repeats performing the same erroneous operation as indicated by the warning screen WS-C or when the user fails to fix or correct the abnormal condition indicated by the warning screen WS-C into the normal condition (warning state D).

FIG. 7(*e*) shows one example of the warning screen WS-E. The warning screen WS-E has the red background and has symbol S-E (angry face). The warning screen WS-E is displayed when the user performs any one of a plurality of dangerous operations predetermined for the sewing machine 1 or when the sewing machine 1 is brought into any one of a plurality of dangerous conditions predetermined for the sewing machine 1 (dangerous state E).

Figure 4:
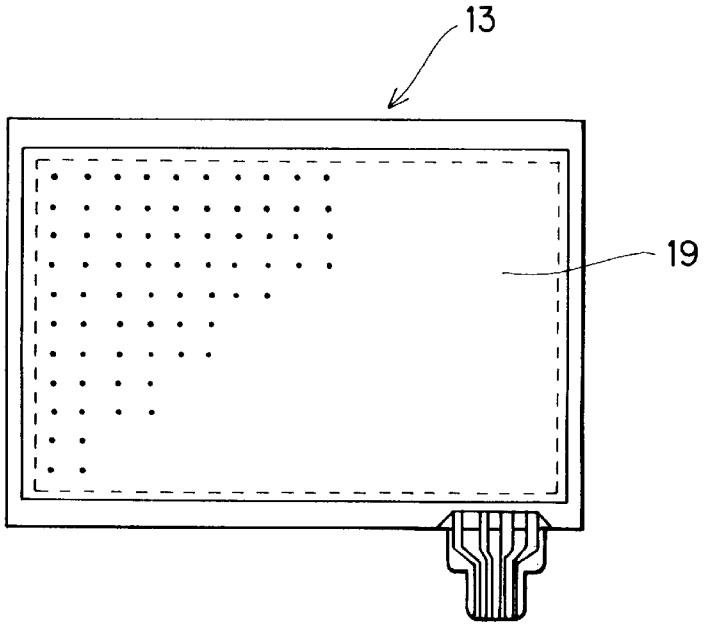
FIG. 4 illustrates the structure of a touch panel provided on the display device.

As shown in FIG. 4, the touch panel 13 is located over the upper surface of the LCD 12. The user can touch the touch panel 13 to select and set embroidery patterns, characters, and symbols displayed on the operation screen OS of the LCD 12. The touch panel 13 is formed with a plurality of keys 19 arranged in a dot matrix form over the entire area of the LCD 12.

Figure 2:
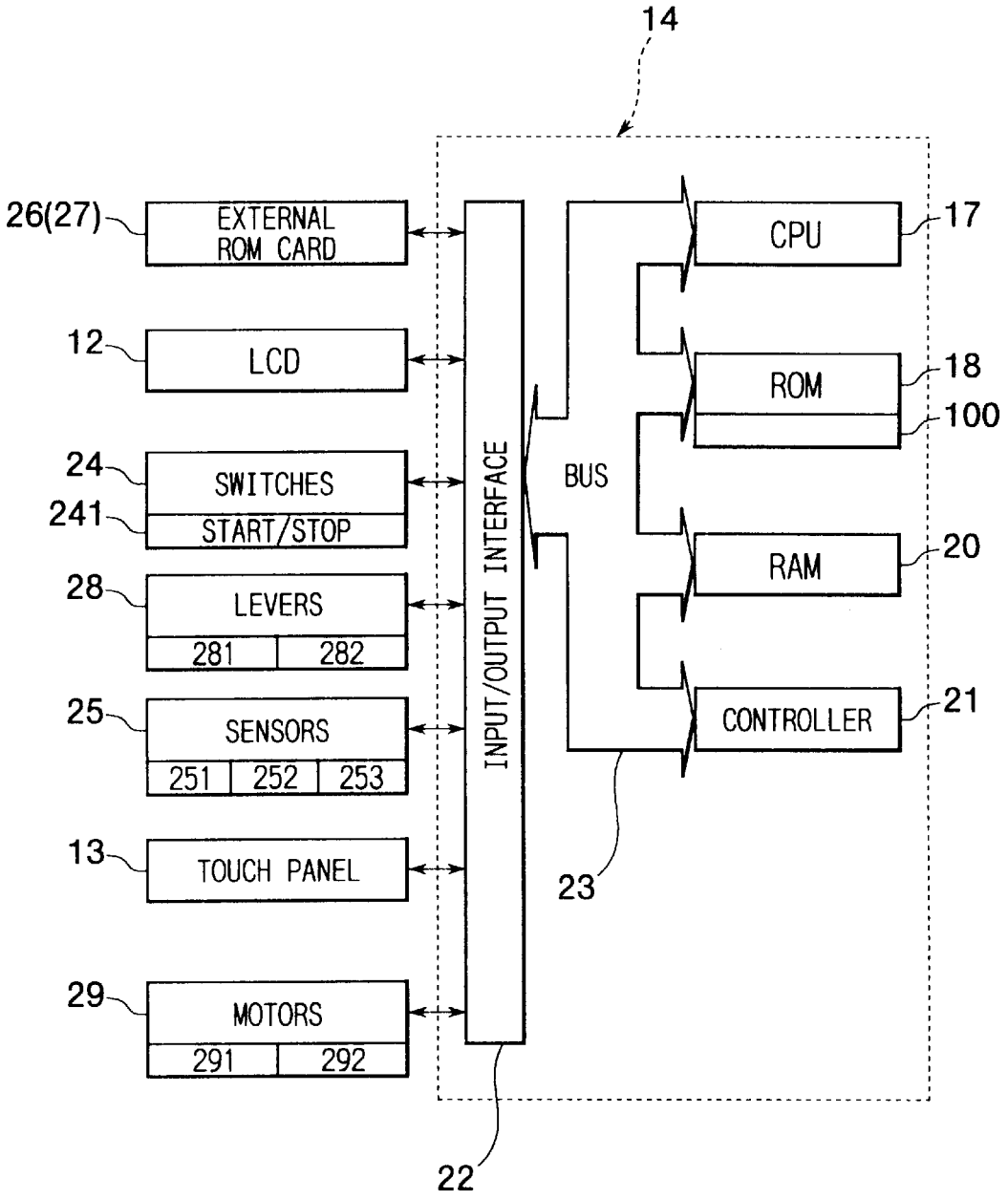
FIG. 2 is a block diagram showing an internal structure of the sewing machine.

As shown in FIG. 2, the control panel 14 includes: a CPU 17, a ROM (read only memory) 18, a RAM (random access memory) 20, an LCD controller 21. an input/output interface 22, and a bus 23.

The ROM 18 stores therein data for creating a plurality of predetermined warning screens WS (WS-A through WS-E). The ROM 18 also stores therein data for creating the plurality of operation screens OS. The ROM 18 further stores therein information on the plurality of operational states (A–E) predetermined for the sewing machine 1. The ROM is further stores therein data of control programs to be executed by the CPU 17. The control program include sewing control programs shown in FIGS. 9 and 10.

The RAM 20 is for temporarily storing various data during the sewing control operation. For example, the RAM 20 stores stitch data of the user's selected pattern retrieved from the external ROM card 26.

The CPU 17 is for executing the control programs stored in the ROM 18 to control the entire sewing machine 1. The CPU 17 is also for performing calculation operation to display an appropriate operation screen OS and an appropriate warning screen WS with using data stored in the ROM 18 and the RAM 20.

The LCD controller 21 is for controlling the LCD 12 to display the operation screen OS and the warning screen WS. The input/output interface 22 is for controlling input/output of data to and from the control panel 14. The bus 23 electrically connects the input/output interface 22 with the CPU 16, the ROM 18, the RAM 19, and the LCD controller 21.

The input/output interface 22 is connected to: the LCD 12; the touch panel 13; a plurality of switches 24; a plurality of sensors 25; a plurality of levers and other operation members 28; a plurality of motors 29; the external ROM card 26 mounted in the card reading device 27; and the like.

The plurality of switches 24 are provided for enabling the user to start, to stop, and to set various operations of the sewing machine 1. A representative example of the switches 24 is the start/stop switch 241 shown in FIG. 1. The plurality of levers and other operation members 28 are provided for enabling the user to perform other various settings onto the sewing machine 1. Representative examples of the levers 28 are the presser foot lever 281 and the button hole lever 282 shown in FIG. 1. Representative examples of other operation members 28 are: a cloth pressing bar, a lower thread winding shaft, and upper and lower thread setting portions. Each operation member 28 is provided to the sewing machine 1 as accessible by the user. That is, is each operation member 28 can be operated by the user.

The plurality of motors 29 are provided for performing various driving operations. Representative examples of the motors 29 are the sewing machine motor 291: and a zigzag controlling motor 292 for driving the needle bar 5 to move laterally in leftward and rightward directions.

The plurality of sensors 25 are provided to the sewing machine 1 for detecting operational conditions of various parts in the sewing machine 1 and for detecting the user's operation affected onto the sewing machine 1. Representative examples of the sensors 25 include: a motor rotation sensor 251 for continuously monitoring each of the several motors 29 provided in each section of the sewing machine 1; a switch sensor 252 for constantly monitoring the various switches 24 such as the start/stop switch 241; a lever sensor 253 for constantly monitoring the plurality of levers and other operational members 28 such as the levers 281 and 282; and other sensors (not shown) for constantly monitoring other various parts, such as an illumination lamp (not shown) provided to the sewing machine 1. Thus, the sensors 25 can detect all the portions and parts in the sewing machine 1. Each of the sensors 25 outputs the monitored results to the CPU 17.

As described already, each lever 28 can be moved, and should be or should not be located at a corresponding predetermined position under a certain operation state. For example, the button hole lever 282 should be located at its lower position shown in FIG. 1 when sewing a button hole. When sewing a straight stitch, the button hole lever 282 should not be at that lower position. When sewing the straight stitch, the presser foot lever 281 should not be located in its upper position. The sensor 253 detects the positions of the presser foot lever 281 and the button hole lever 282, thereby detecting whether or not each of those levers 28 is in its corresponding correct position. The lever sensor 253 also constantly monitors operational states of other several operation members (not shown) 28.

With the above-described structure, the sewing machine 1 can display each of the warning screens WS-A through WS-E at an appropriate timing. Each warning screen WS is displayed over the operation screen OS, as shown in FIG. 5(*b*), which can serve as the embroidery pattern selection screen or as an illustration screen for embroidery work.

It is now assumed that the operator performs his/her input operation through manipulating the touch panel 13 to input his/her commands to select his/her desired embroidery data. In this case, the CPU 17 reads the embroidery data from the ROM card 26 via the card reading device 27 and then writes the embroidery data to the RAM 20 while checking whether or not the user performs other input operations onto the sewing machine 1.

If the user does not perform any other input operations to obstruct the embroidery data reading operation, the CPU 17 determines that the present status is the correct operational state A, and therefore displays the blue-background warning screen WS-A (FIG. 7(*a*)) on the LCD 12 while transferring the embroidery data from the ROM card 26 to the RAM 20. In this case, the warning screen WS-A shows the happy face S-A and an instruction message as reading "DATA IS NOW RETRIEVING. PLEASE WAIT."

It is further assumed that after completion of the embroidery data reading operation, the user performs no input operation for a predetermined long period of time or longer. In this case, the CPU 17 determines that the present operational state is the waiting state B, and therefore displays the blue-background warning screen WS-B shown in FIG. 7(*b*). The warning screen WS-B shows the normal face S-B and a message requesting the user to input his/her commands.

Thus, the blue-background warning screens WS-A and WS-B are displayed when the user does not perform any erroneous operation and when the operational condition of the sewing machine 1 is normal.

It is further assumed that the user depresses the start/stop key 241 when embroidery data to be sewn has not yet been properly set, when an upper thread or a lower thread is not properly set, when the cloth pressing bar is not located at its lower position to hold down a workpiece, or the like. It is also assumed that the user depresses the start/stop key 241 after selecting the straight stitch and when the presser foot lever 281 is in the upper position. In this case, the CPU 17 recognizes the present condition as conflicts against the user's performed operation. Accordingly, the CPU 17 recognizes the present status as the abnormal, attention state C that is unable to realize a predetermined normal process. In this case, the CPU 17 displays the yellow-background warning screen WS-C as shown in FIG. 7(*c*). The warning screen WS-C shows the sad face S-C and a message requesting the user to correct the present abnormal condition of the sewing machine 1.

It is also assumed that while the CPU 17 is transferring embroidery data from the external ROM card 26 to the RAM 20, the user erroneously depresses the start/stop key 241 to start sewing operation. This user's performed operation is recognized as an error not following a predetermined correct sewing procedure. This is because according to the predetermined sewing procedure, sewing should be performed only after embroidery data is completely transferred to the sewing machine 1. Also in this case, the CPU 17 displays the yellow-background warning screen WS-C. The warning screen WS-C shows the sad face S-C and a message Indicating that another process is presently being operated.

Thus, the warning screen WS-C is displayed when the user performs his/her erroneous operation different from the predetermined manual procedure or when the sewing machine 1 is in an abnormal condition incapable of performing the predetermined normal process.

It to further assumed that while the message screen WSC is being displayed, the user again performs the same erroneous operation that has originally caused the LCD 12 to display the warning screen WS-C. It is also assumed that while the warning screen WS-C is being displayed, the user fails to correct the present abnormal condition before performing again the same operation that has originally caused the LCD 12 to display the warning screen WS-C. In both of these cases, the CPU 17 determines that the present operational state is the warning state D. and therefore displays the orange-background warning screen WS-D as shown in FIG. 7(*d*). The warning screen WS-D shows the crying face S-D and a message again urging the user to correct his/her erroneous operation or the present abnormal condition.

Thus, the warning screen WS-D is displayed when the user repeatedly performs the same erroneous operation or when the user repeatedly performs the same operation without correcting the abnormal condition of the sewing machine 1.

It is assumed that while the sewing machine 1 is performing a sewing operation to sew an embroidery, when the thread is tangled, the needle 6 is bent, or another dangerous condition occurs, the sewing machine motor 291 is locked according to a safety operation. In this case, the CPU 17 determines that the present status is the dangerous state E. Accordingly, the CPU 17 displays the red-background warning screen WS-E as shown in FIG. 7(*e*). The warning screen WS-E shows the angry face S-E and a message strongly warning the user to check the sewing machine 1.

It is noted that the user is prohibited from performing the plurality of predetermined actions or operations during the manual procedure for the sewing machine 1. For example, the user is prohibited from moving or shifting the lower thread winding shaft, the cloth pressing bar, and the like while the sewing machine 1 performs a sewing operation. It is dangerous to move those parts during the sewing operation. Those parts may possibly be damaged, or the user may possibly be injured.

It is assumed that while the sewing machine 1 is performing a sewing operation to sew an embroidery, the user shifts the lower thread winding shaft. In this case, the CPU 17 regards the user's performed operation as prohibited and determines that the present status is the dangerous state E. Accordingly, the LCD 12 displays also the red-background warning screen WS-E. The warning screen WS-E shows the angry face S-E and a message strongly warning the user not to perform the same operation again.

Thus, the LCD 12 displays the warning screen WS-E when the sewing machine 1 becomes the dangerous state or when the user performs one of the prohibited actions or operations predetermined according to the manual procedure.

As apparent from the above description, when the blue-background screen WS-A with the happy face S-A is displayed, the user can easily and immediately know that the user's performed action is allowed and the sewing machine 1 is presently performing normal operation in response to the user's allowed action.

When the blue-background screen WS-B with the normal face S-B is displayed, the user can easily and immediately know that the present status of the sewing machine 1 is normal, but is waiting for the user's next action.

When the yellow-background screen WS-C with the sad face S-C is displayed, the user can easily and immediately know that the user's performed action is erroneous or the present status of the sewing machine 1 is in an abnormal condition. The screen WS-C can therefore allow the user to pay his/her attention to his/her action or the present status of the sewing machine 1.

When the orange-background screen WS-D with the crying face S-D is displayed, the user can easily and immediately know that the user has repeatedly performed the erroneous action or the user has failed to restore the present abnormal status of the sewing machine 1 into a correct condition. The screen WS-D can therefore allow the user to carefully perform his/her next action.

When the red-background screen WS-E with the angry face S-E is displayed, the user can easily and immediately know that the user has performed a dangerous action or the sewing machine 1 has been brought into a dangerous condition. The screen WS-E can therefore allow the user never to perform the dangerous action and to urgently check the sewing machine 1.

Thus, the warning screens WS-A through WS-Z are designed such that as the status of the user's action and the sewing machine condition becomes dangerous, the background color becomes reddish and the symbol face gives strongly-urging impression. In other words, the background color and the symbol impression changes more serious as the danger level of the status increases. With this design, at a glance of each warning screen WS, the user can immediately and certainly know the present status.

Figure 8A:
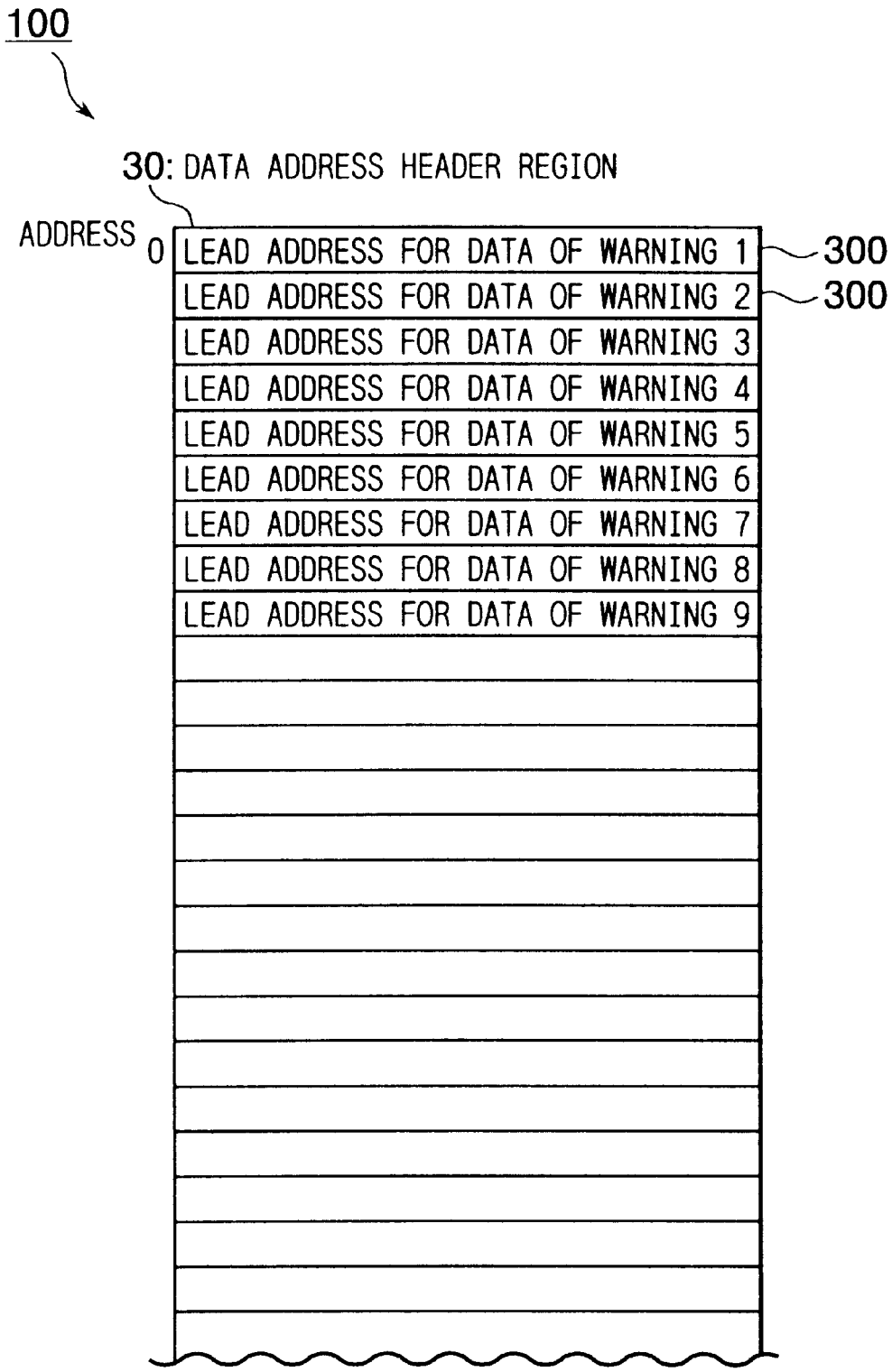
FIG. 8(*a*) shows a data address header prepared in a ROM.
Figure 8B:
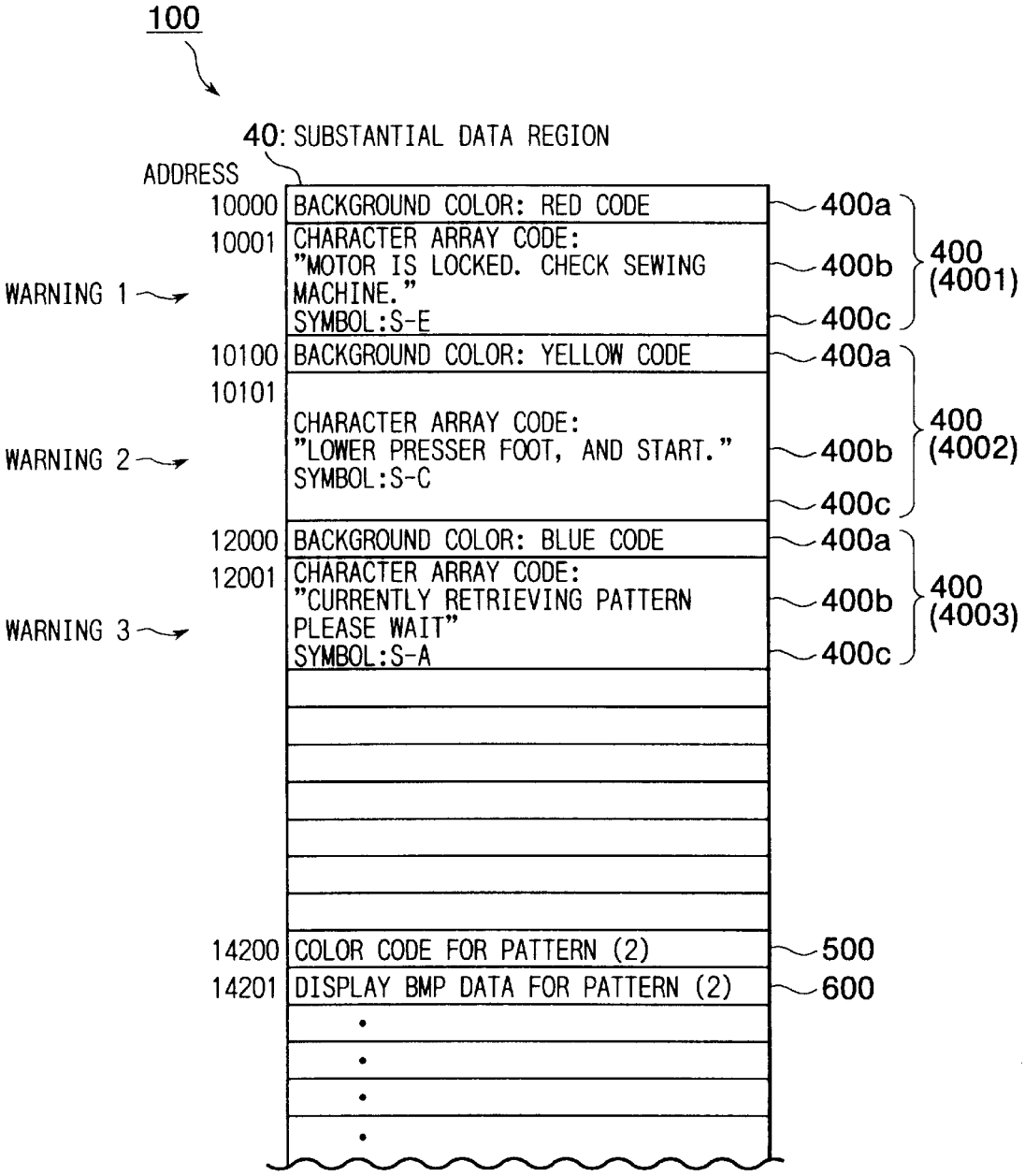

As shown in FIG. 2, the ROM 18 is formed with a warning screen data region 100 previously storing therein a plurality of sets of warning screen process data 400 for displaying the plurality of warning screens WS (WS-A through WS-E). More specifically, as shown in FIGS. 8(*a*) and 8(*b*), the warning screen data region 100 is comprised of: an address data header region 30 and a substantial data region 40. The address data header region 30 is located in an upper area of the region 100, while the substantial data region 40 is located in a remaining lower area.

As shown in FIG. 8(*b*), the substantial data region 40 is stored with the plurality of sets of warning screen process data 400 indicative of the plurality of warning screens WS which are to be displayed on the LCD 12 and which are identified with warning numbers beginning from one (1). The plurality of warning screens WS, indicated by all the sets of warning screen process data 400, are categorized into the above-described five warning screens WS-A through WS-E according to their danger levels.

Each set of warning screen process data 400 includes: a background color code data 400*a;* a character code array data 400*b;* and a symbol data 400*c*. The background color code data 400*a* is indicative of a background color of the corresponding warning screen WS, that is, any one of blue, yellow, orange, and red. The character code array data 400*b* is indicative of a message (character strings) to be displayed on the message display region MD. The symbol data 400*c* is indicative of a corresponding symbol, that is, either one of the symbols S-A through S-E to be displayed on the symbol display region SD.

As shown in FIG. 8(*a*), the address data header region is stored with a plurality of sets of lead address data 300 for all the plurality of warning screen process data sets 400 stored in the substantial data region 40 as identified with warning numbers beginning from one (1). Each lead address data set 300 is indicative of a lead address, from which the corresponding warning screen process data 400 is stored in the region 40.

For example, as shown in FIG. 8(*b*), a first set of warning screen process data 4001 (warning 1) is stored from its lead address "100000". This data set 4001 includes: "red" color code data 400*a;* character code array data 400*b* indicative of a message as reading "MOTOR IS LOCKED, CHECK SEWING MACHINE"; and a symbol data 400*c* indicative of the symbol S-E. Accordingly, when the sewing machine motor 291 locked during the sewing operation, the red-background message screen WS-E shown in FIG. 7(*e*) will be displayed to show the angry face S-E and the message reading "MOTOR IS LOCKED, CHECK SEWING MACHINE".

A second set of warning screen process data 4002 (warning 2) is stored from its lead address "10100". This data set 4002 includes: "yellow" color code data 400*a;* character code array data 400*b* indicative of a message as reading "PRESSER FOOT LEVER IS IN ITS UPPER POSITION, LOWER PRESSER FOOT LEVER BEFORE START"; and symbol data 400*c* indicative of the sad face S-C. Accordingly, when the user inputs his/her start command before properly lowering the presser foot lever 281, the yellow-background message screen WS-C shown in FIG. 7(*c*) will be displayed to show the sad face S-C and the message "PRESSER FOOT LEVER IS IN ITS UPPER POSITION, LOWER PRESSER FOOT LEVER BEFORE START".

A third set of warning screen process data 4003 (warning 3) is stored from its lead address "12000". This data set 4003 includes: "blue" color code data 400*a;* character code array data 400*b* indicative of a message as reading "CURRENTLY RETRIEVING PATTERN, PLEASE WAIT"; and symbol data indicative of the symbol S-A. Accordingly, when the user properly selects his/her desired embroidery pattern, the blue-background warning screen WS-A shown in FIG. 7(*a*) will be displayed to show the happy face S-A and the message "CURRENTLY RETRIEVING PATTERN. PLEASE WAIT".

It is noted that as shown in FIG. 8(*b*), the substantial data region 40 further stores therein other sets of color code data 500 to be used for displaying the embroidery pattern selection screen OS to be displayed on the LCD 12. The substantial data region 40 further stores therein bit map (BMP) data 600 to be used for displaying each embroidery pattern to be selected on the embroidery pattern selection screen OS.

With the above-described structure, the sewing machine 1 performs its sewing process while displaying the warning screens WS when necessary in a manner described below with reference to FIGS. 9 and 10.

When a power supply (not shown) of the sewing machine 1 is first turned ON, several types of initial setting operations are executed in S1. For example, the RAM 18 is initialized. Then, in S2, the CPU 17 automatically selects a predetermined straight stitch pattern (1) as initially-set embroidery data.

Next, the LCD 12 is controlled in S3 to perform a display process for displaying the predetermined embroidery selection screen OS as shown in FIG. 5(*a*) for enabling the user to select his/her desired sewing pattern.

Next, the CPU 17 judges in S4 whether the user has selected his/her desired sewing pattern through manipulating the keys 19 located on the presently-displayed embroidery selection screen OS. When the user performs his/her selection process (Yes in S4), the program proceeds to S12 where the CPU 17 judges whether the present operational status is abnormal or the user's performed operation is erroneous. This judgment is performed based on detection results supplied from all the sensors 25.

On the other hand, when the selection process is not performed (No in S4), the program proceeds to 55 where the CPU 17 further judges whether or not the user manipulates any keys on the touch panel 13. When the user manipulates some key (Yes in S5), the program proceeds also to S12 where the CPU 17 judges whether the present operational status is abnormal or the user's performed operation is erroneous.

When the operator performs no operations onto any keys (No in S5), the CPU 17 further judges in S6 whether cannot the user inputs his/her sewing start command through manipulating the start/stop switch 241.

When the user does not input his/her sewing start command (No in S6), the program proceeds to S15 where the CPU 17 judges whether the user has not performed any operations for the predetermined long period of time or longer. When the user has not performed any operations for the predetermined long period of time or longer (no in S15), the program proceeds to S16 where the CPU 17 recognizes the present status as the waiting state B and controls the LCD 12 to display the warning screen WS-B. Then, the program returns to S4 where the user selects his/her desired embroidery pattern. On the other hand, when the user has performed some operations during the predetermined long period of time (yes in S15), the program directly returns to S4.

On the other hand, when the user inputs his/her sewing start command through manipulating the start/stop switch 241 (Yes in S6). On the other hand, the CPU 17 first judges in S7 whether or not the present operational condition is abnormal or the user's performed operation onto the start/stop switch 241 is erroneous. This judgment is executed also based on detection results supplied from the sensors 25. When the present operational condition is abnormal or the user's performed action is erroneous (Ng in S7), the program proceeds to S8. In S8, the CPU 17 recognizes contents of the present status, and controls the LCD 12 to display the warning screen WS, that is, any one of the warning screens WS-C through WS-E. Then, the program returns to S6.

On the other hand, when the present operational condition is normal and the user's performed action is correct (ok in S7). the CPU 17 performs an embroidery sewing process in S9 based on information which has been selected by the user in S3 on the LCD 12. During the sewing process of S9, the CPU 17 monitors the present status. The CPU 17 controls the LCD 12 to display the warning screen WS-E when the present status becomes the dangerous state E or when the user performs a highly dangerous operation. Thereafter, the CPU 17 judges in S10 whether the user inputs his/her sewing stop command through manipulating the start/stop switch 241. Until the user inputs his/her sewing stop command (No in S10), the program repeatedly returns to S9. continuing the sewing process.

When the user inputs his/her sewing stop command (yes in S10), the CPU 17 judges in S11 whether the power supply of the sewing machine 1 is turned Off. When the power supply is turned Off (Yes in S11), the sewing process is ended. On the other hand, when the power supply is not turned Off (No in S11), the program returns to S4 to select another embroidery pattern to be sewn.

In S12, the CPU 17 judges whether the present operational condition of the sewing machine 1 is abnormal or the user's performed operation is erroneous. This judgment is executed based on the detection results supplied from the sensors 25. When the present operational condition is abnormal or the user's performed action is erroneous (Ng in S12), the program proceeds to S14. In S14, the CPU 17 recognizes contents of the present status, and controls the LCD 12 to display the warning screen WS, that is, either one of the warning screens WS-C through WS-E. Then, the program returns to S3.

On the other hand, when the present operational condition is normal and the user's performances are correct (Ok in S12), the CPU 17 starts performing normal processes in S13 in response to the user's action performed in S4 or S5. That is, the CPU 17 starts performing an embroidery selecting-and-retrieving operation in response to the user's selection in S4 or starts performing a necessary process according to the key manipulated in S5. The CPU 17 also monitors the present status, and controls the LCD 12 to display the warning screen WS-A if necessary for a predetermined period of time. Thereafter, the program returns to S3 to proceed to the sewing process. It is noted that the program returns to S3 even when the process responding to the user's manipulation in S4 or S5 is not yet completed. Accordingly, the judging process from S4 can start even while the CPU 17 is still performing the processes in response to the user's operation in S4 or S5. It is noted that data of the predetermined long period of time used in the judgment process of S15 is predetermined as sufficiently longer than a time period required to complete each process started to be performed in S13.

With the above-described control procedure, after some warning screen WS is displayed in each of S8 and S14 to notify the user of the present status, if another status with a higher danger degree occurs thereafter, another warning screen WS of a higher dangerous degree is displayed. For example, after some warning screen WS is displayed in S14 to notify the user of the present abnormal condition or the user's erroneous operation, if an abnormal condition with a higher danger degree occurs or the operator performs an erroneous operation with a higher danger degree, the program proceeds again via the process of S12 to S14 where another warning screen WS of a higher danger degree is displayed.

Especially after some warning screen WS-C is displayed in each of the process of S8 and S14 to notify the user of the present abnormal condition or the user's erroneous operation, if the abnormal condition is not corrected or the operator again performs the erroneous operation, the program again proceeds with the same process, resulting that another warning screen WS-D of a higher danger degree is displayed.

For example, it is now assumed that the user selects sewing the straight stitch and inputs his/her sewing start command (yes in S6) before raising the button hole lever 282.

In this came, the program proceeds to S8 where a warning screen WS-C is displayed. The warning screen WS-C is yellow background, and shows the sad face S-C with a message reading "RAISE BUTTON HOLE LEVER." Afterward, the program returns to S6. At this time, if the user again inputs his/her sewing start command (yes in S6) without raising the button hole lever 282. the program again proceeds to S8 (ng in S7) where another warning screen WS-D is displayed. The warning screen WS-D is orange background, and shows the crying face S-D with the some message reading "RAISE BUTTON HOLE LEVER."

The warning screen display process of S14 will be described below in greater detail with reference to FIG. 10.

During the warning screen display process of S14, the CPU 17 first retrieves in S113 from the ROM 18 a set of warning screen process data 400 corresponding to the present status. More specifically, the CPU 17 first refers to the address data header 30, and searches a lead address, from which a set of warning screen process data 400 for the present status is stored.

Next, in 5114, the CPU 17 controls the LCD 12 to display a background of the warning screen WS (symbol display region SD and the message display region MD) at a color indicated by a set of color code data 400*a* included in the retrieved warning screen process data set 400. Next, in S115, the CPU 17 controls the LCD 12 to display, on the message display region MD, trains of characters corresponding to a set of message data (character code array data) 400*b* included in the retrieved warning screen process data set 400. Simultaneously, the CPU 17 controls the LCD 12 to display, on the symbol display region SD, a symbol (either one of the symbols S-A through S-E) corresponding to a set of symbol data 400*c* included in the retrieved warning screen process data set 400. Thus, the warning screen WS is created at the background color indicated by the retrieved color code data and to show a message indicated by the retrieved character code array data and a symbol indicated by the retrieved symbol data. Then, the program returns to the main routine.

Figure 9:
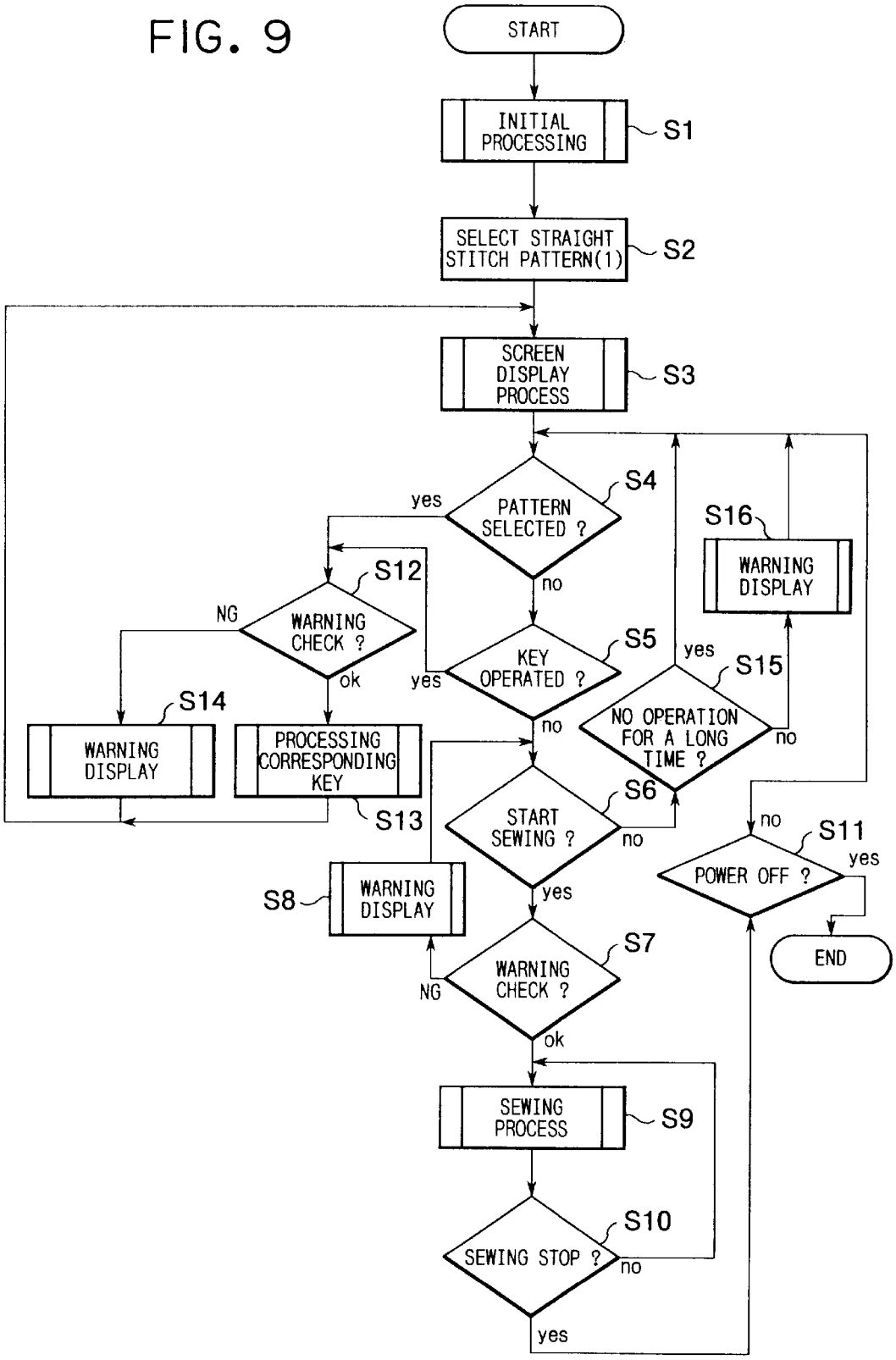
FIG. 9 is a flowchart of an entire sewing process performed by the sewing machine of the present embodiment.
Figure 10:
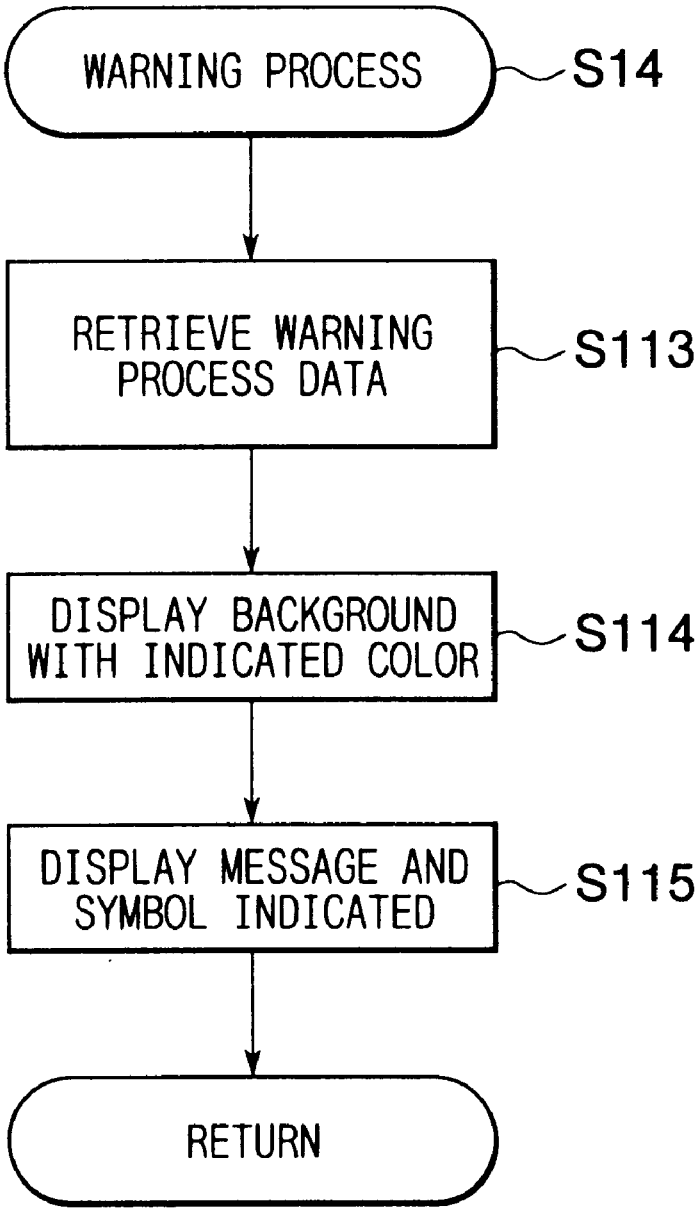
FIG. 10 is a flowchart of a warning screen display process in the process of FIG. 9.

In each of the processes of S8, S9, S13, and S16 of FIG. 9, the CPU 17 executes the same processes as described above for the warning screen display process of S14. It is noted that the process of 514 displays either one of the warning screens WS-C through WS-E. This is because the process of S14 is performed only when some abnormal state, that is, either one of the attention state C, the warning state D, or the dangerous state E, is detected in S12 (Ng in 512). Similarly, the process of S8 displays either one of the warning screens WS-C through WS-B. This is because the process of S8 is performed only when some abnormal state, that is, either one of the attention state C, the warning state D, or the dangerous state E, is detected in S7 (Ng in S7). Contrarily, the process of S9 displays only the warning screen WS-E when some dangerous state E is detected during the sewing operation. The process of S13 displays only the warning screen WS-A because the process of S13 executes a proper operation. The process of S16 displays only the warning screen WS-B because the process of S16 is performed only when the waiting state B is detected in S15 (no in S15).

Thus, according to the present embodiment, when the user properly selects his/her desired sewing pattern (yes in S4 and yes in S12), the sewing machine 1 starts retrieving data for the selected pattern from the external ROM card 26 in S13 while displaying the warning screen WS-A shown in FIG. 7(*a*). If the user erroneously manipulates the start/stop switch 241 before the data retrieving operation is completed (Ng in S7), the warning screen WS-C is displayed in S8 to notify the user that another process is still being executed.

After the data retrieving operation, if the user does not perform any input operation for the predetermined long period of time or more (no in S15), the warning screen WS-B of FIG. 7(*b*) is displayed in 516 to request the user to perform the next processing. After selecting the straight stitch, if the user manipulates the start/stop switch 241 without lowering the presser foot lever 281 (ng in S7), the warning screen WS-C of FIG. 7(*c*) is displayed in S8. If the user again manipulates the start/stop switch 241 without still lowering the presser foot lever 281 (ng in S7), the warning screen WS-D of FIG. 7(*d*) is displayed in S8. During the sewing operation, when the needle 6 is bent and the sewing machine motor 291 is locked, the warning screen WS-D of FIG. 7(*e*) is displayed in S9.

As described above, according to the present embodiment, the sewing machine 1 is provided with the LCD 12 that is capable of displaying color images. The sensors 25 are provided to detect operational status of the sewing machine 1. The CPU 17 is provided to control the display 12 to notify the user of the detected operational status through changing, according to the detected results, the background color of the warning screen WS that includes the symbol display region SD and the message display region MD. Thus, according to the present embodiment, the operation state of the sewing machine 1 is notified to the user by the color displayed on the LCD 12. The user can therefore easily know the present status immediately. The LCD 12 changes the background color of the warning screen WS based on the detected operation status, thereby enabling the user to easily and immediately recognize the present status.

Especially, according to the present embodiment, when the detected operation status is determined as abnormal or erroneous, the detected operation status is determined as either one of the first through third danger levels; attention level C, warning level D, and dangerous level B. The color of the LCD screen 12 is controlled in correspondence with the determined danger level. Viewing the LCD screen 12, the user can easily acknowledge how the present abnormal status is dangerous.

More specifically, yellow color is displayed when the present status is in the lowest dangerous level C that the user has to pay his/her attention to the present status. Orange color is displayed when the present status is in the middle danger level D that the user has to perform his/her operation more carefully. Red color is displayed when the present status is in the highest danger level E that is considerably dangerous and therefore that the user has to is perform his/her operation most carefully. With this arrangement, the user can easily recognize the danger level of the present status.

Figure 6:
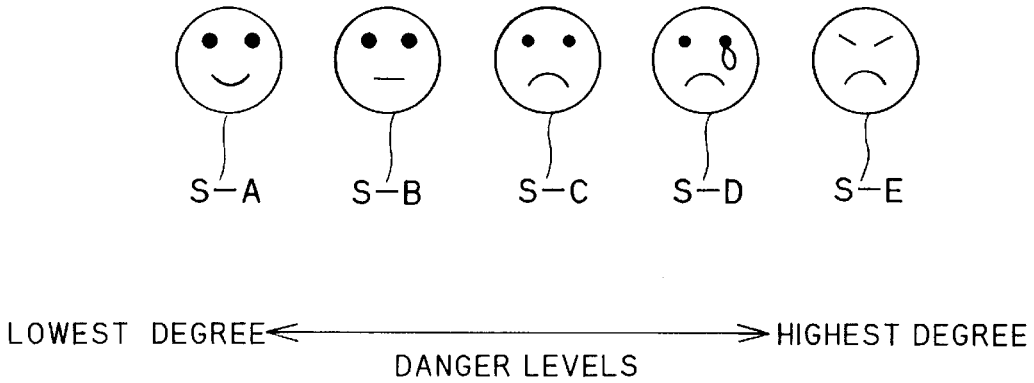
FIG. 6 shows examples of the symbols displayed on a plurality of warning screens WS.
Figure 7A:
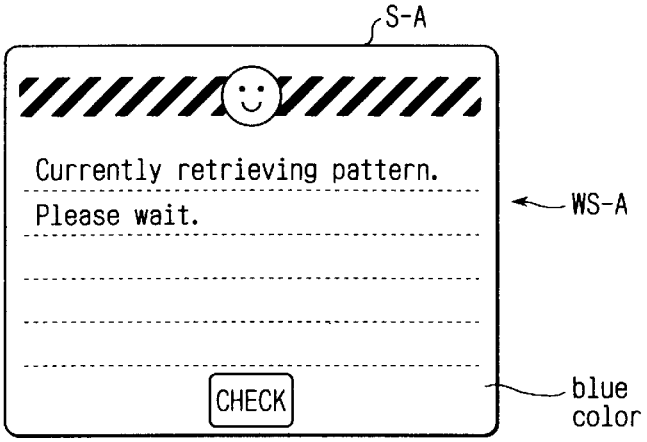
FIG. 7(*a*) shows one example of a warning screen WS-A indicative of a normal operational state A.
Figure 7B:
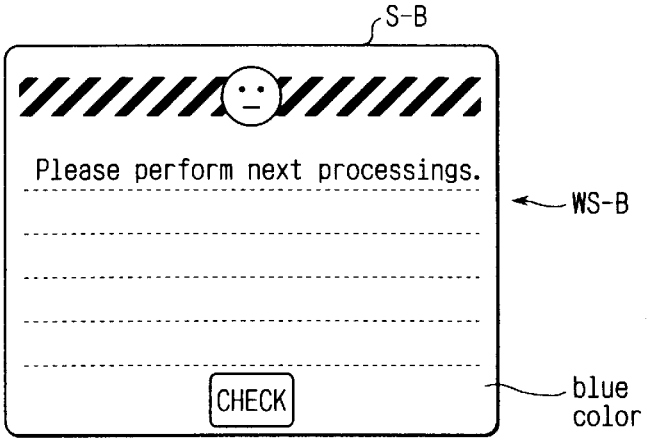
Figure 7C:
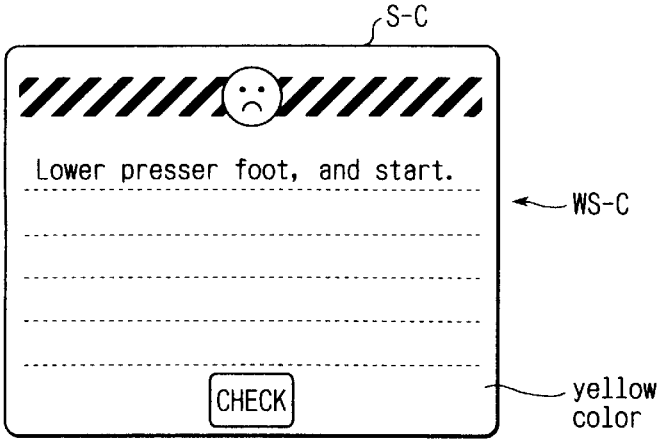
Figure 7D:
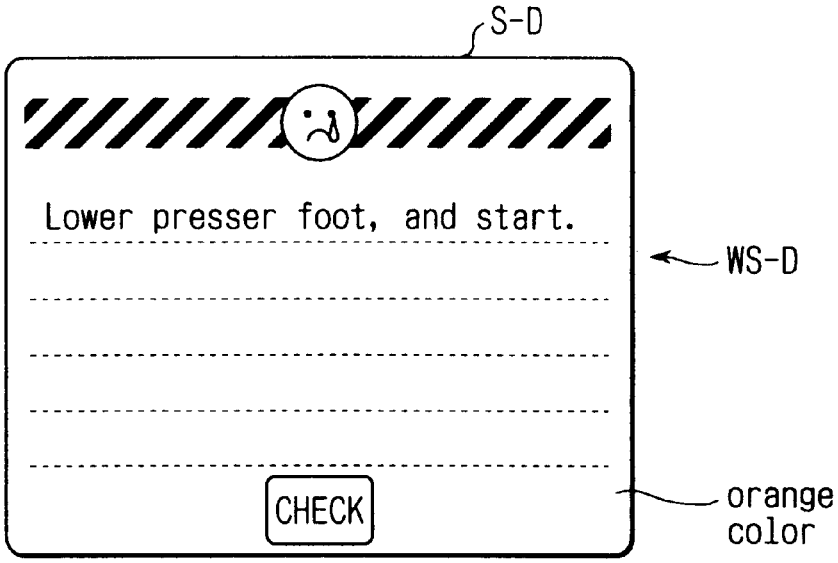
Figure 7E:
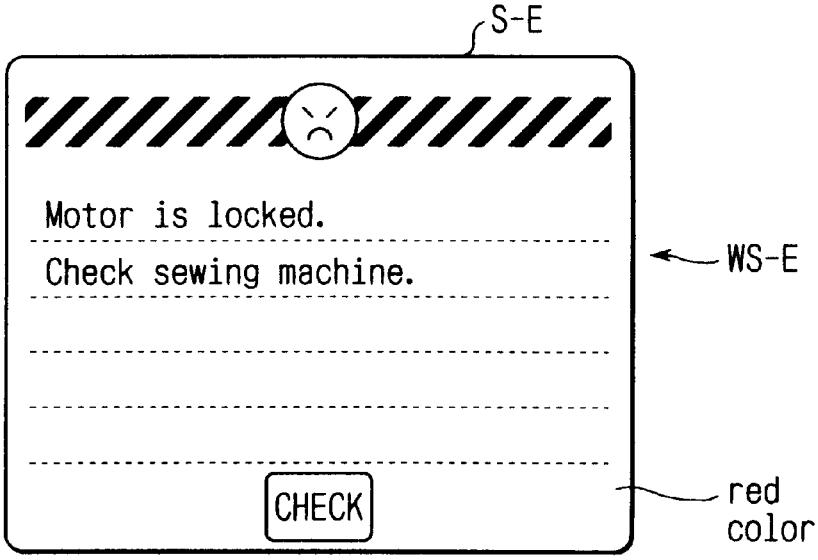

The symbol S shown in the warning screen WS also changes as shown in FIG. 6 in accordance with the change in the background color. Viewing changes in the symbol S together with the background color, the user can easily know the changes in the operation status.

According to the present embodiment, the background colors of yellow, orange, and red are determined in accordance with the three levels: attention level C, warning level D, and dangerous level E, respectively. The three different levels C, D, and E are defined in the order of the increasing dangerous level so that the danger level E is the highest danger level. Thus, according to the present embodiment, this single set of levels C, D, and E is defined according to one aspect how the present status influences dangerous effects onto the sewing operation. However, other various sets of plural levels may be defined according to other aspects. For example, various sets of plural levels may be defined according to those aspects: how seriously the present status causes problems on the sewing operation; how much troublesome work and costs are required to solve the present status; and whether the present status is related to any parts or members significant to sewing operation. According to each aspect, a plurality of different levels are defined according to how much influences each level gives to the sewing operation. The present status is allocated to one of the thus defined plurality of different levels according to the corresponding aspect. Then, a background color indicative of a high degree of danger, significance, and urgency is displayed when the present status is detected to cause very serious problems on the sewing operation, to cause problems that require troublesome work and costs, or to be related to the parts or members significant to the sewing operation. The high-degree background color shows that the present status is highly related to the sewing operation with reference to the aspects of danger, significance, and urgency. Representative examples of the parts and members that are significant to the sewing operation and therefore that will cause serious problems when they are damaged include: the external memory card 26, the card reading device 27, the sewing machine motor 291, the sewing needle 6, and the like. When one of the above-listed members is broken, it becomes impossible to perform the sewing operation.

According to the present embodiment, there are defined three different danger levels: attention level C, warning level D, and dangerous level E. More than one sub-levels may be further defined for each of the levels.

In the present embodiment, the three background colors "yellow", "orange", and "red" are defined in correspondence with the three danger levels "attention," "warning," and dangerous which are indicative of the degrees of influences to be affected onto the sewing operation. Viewing either one of the background colors presently displayed on the warning screen WS, the user can immediately know how the present status is dangerous and significant and how the present status should be urgently coped with.

Especially, according to the present embodiment, as the danger and urgency level increases, the background color changes from "yellow" through "orange" to reach "red". Thus, as the danger and urgency level increases, the background color becomes reddish and changes into a higher degree to give stronger impression to viewers. Accordingly, viewing the background color, the user can immediately know which of the plurality of danger levels the present status reaches. The user will try to carefully perform his/her operation, preventing any possible erroneous and dangerous operations. This will prevent occurrence of possible accidents during the sewing operation.

Especially, according to the present embodiment, the symbols S-C through S-E are also displayed on the warning screens WS-C through WS-E. Those symbols represent different expressions of the single imaginary person's face. As the danger and urgency level increases, the face's expression changes into a higher degree to give stronger impression to viewers. Accordingly, viewing the symbol, the user can immediately know which of the plurality of danger levels the present status reaches.

It is noted that the sewing machine motor 291 will possibly be damaged when the sewing machine motor 291 is applied with a high load for a too long period of time. Considering this problem, it may be desirable to design the sensor 251 to also detect a period of time the sewing machine motor 291 is continuously applied with an unacceptable high load. As the detected time increases, the background color of the warning screen WS will be controlled to change from the yellow color of the lower degree into the reddish color (orange and red) of higher degrees of danger and urgency. The symbol S can be changed together with the background color.

In this modification, the background color is changed according to the change in the condition of a single part or member (motor 291 in this example) in the sewing machine 1. However, the background color may be used differently for a plurality of parts or members in the sewing machine 1. For example, even when an auxiliary irradiation lamp (not shown) burns out, the sewing operation is not troubled so much as the damage of the sewing machine motor 291. Accordingly, the burning out of that lamp to preferably notified by the background color of a low significance, for example, "yellow". The symbol can be changed together with this change in the background color.

In the present embodiment, the danger level is displayed by the display device 11 with using the LCD 12. However, the danger level can be notified through controlling the volume or pitch of another notification device (not shown) such as a buzzer independently from or in combination with the display device 11. For example, as the danger level increases, the volume of the buzzer may be increased so that the user can reliably be noticed.

Figure 11:
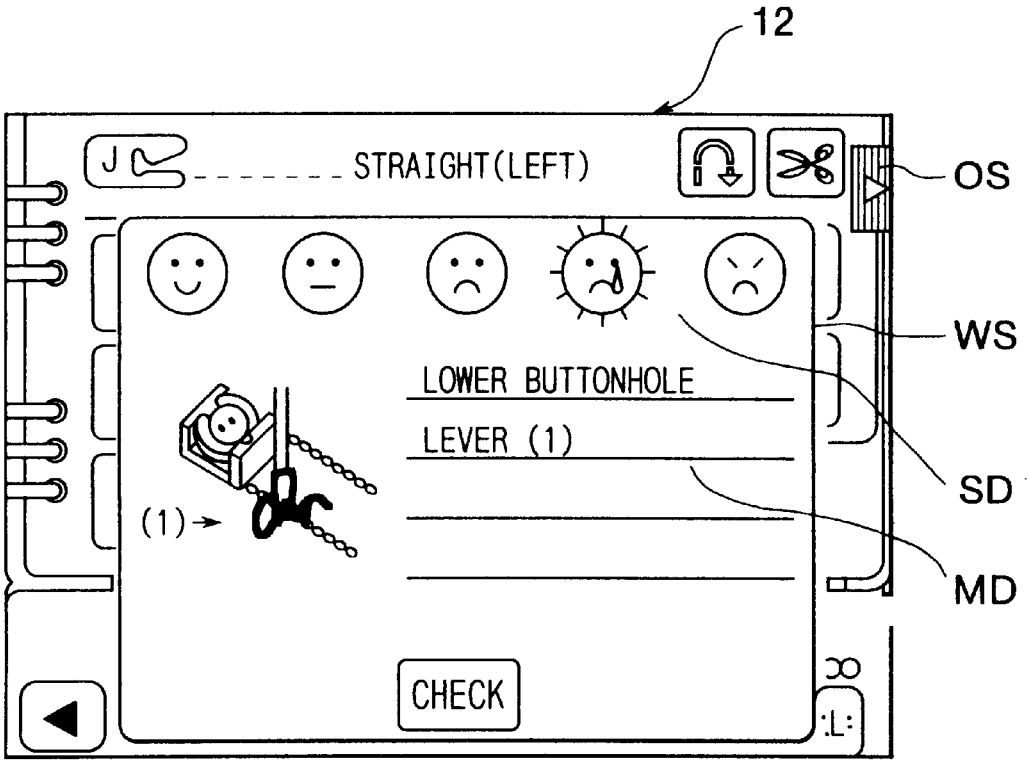
FIG. 11 shows another example of the warning screen.

In the present embodiment, a single symbol S is displayed on each warning screen WS together with a corresponding message. The symbol represents an expression of the imaginary person's face. However, as shown in FIG. 11, the symbol display region SD may always display symbols of all the danger levels A–E. In order to notify one danger level of the present status, a corresponding symbol may be highlighted or blinked on a corresponding background color.

In the present embodiment, the ROM 18 is prestored with: data 400*a* of all the background colors; data 400*c* of all the symbols S; and data 400*b* of all the messages to be displayed on the warning screens WS. However, data (character code array data) 400*b* of all the messages to be displayed on the message display region MD may be stored in the external ROM card 26. This modification in advantageous when the external ROM cards 26 are produced in a plurality of language versions so that each card 26 contains information in a corresponding single language. In this case, the card 26 stores all the sets of message data 400*b* in the corresponding language. All the symbols S-A through S-E and all the background colors (blue, yellow, orange, and red) stored in the ROM 18 can be used in common to all the languages. When the user uses one card 26 for his/her own language, the warning screen WS will display the message in his/her own language while displaying the symbol and the background color retrieved from the ROM 18. In this modifications the storage capacity of each external ROM card 26 can be decreased. Also in this modification, data of the symbols S-A through S-E and data of the background colors can be stored in the external ROM card 26 together with data of the messages. Only the data of the control program for controlling the symbols, the background colors, and the messages is stored in the ROM 18. The sewing machine 1 of the present embodiment is designed to notify the user of the conditions; "attention", "warning," and dangerous. However, the sewing machine can be modified to notify the user further of the conditions: "damages" and "processing error." At least one of the conditions "attention", "warning," dangerous, "damage," and processing errors can be automatically notified by the warning screen WS. Other various conditions related to the sewing operation can be notified to the user.

The present embodiment is related to the sewing machine 1. However, the present embodiment may be applied to a sewing data producing device for producing sewing data to be sewn by the sewing machine 1. It is noted that the sewing data producing device may possibly produce improper data that can cause the sewing machine 1 to produce embroideries with a too small thread density or embroideries accompanied with undesirable thread knots. The sewing data producing device may be designed to notify the user of the present status according to the thread density or the knot density. In this case, the user can know, before starting the actual sewing operation, how the produced sewing data will lower the sewing quality.

The present embodiment can be applied to the sewing machine 1 of a type that to provided with an automatic power off function. In this case, the sewing machine 1 to designed so that as a remaining time period shortens until the power supply be automatically cut off, the display will show that the present condition is approaching to its final power off state through changing the background color (and the symbol) to a higher level. Viewing this change in the displayed background color (and symbol), the user will try to access the sewing machine 1 before the power is automatically shut down.

The sewing machine 1 may be designed to notify the user how difficult it is to sew an embroidery or clothes that the user presently desires to sew. As the sewing difficulty becomes high, the sewing machine 1 displays the background color (and the symbol) of the higher level. Viewing the displayed background color (and symbol), the user will know how difficult to sew his/her desired embroidery or clothes before he/she starts sewing.

In the present embodiment, the present condition is detected, and then the detected result is notified to the user. However, detection may not be performed, but only data processing may be performed. That is, before starting the sewing operation, the sewing machine 1 performs data processings to presume whether or not the sewing operation will be troubled. That is, the sewing machine 1 presumes whether or not the sewing machine 1 will became out of order, whether or not the sewing operation will be troubled with data error, whether or not the sewing machine 1 will be damaged, or whether or not the sewing operation will become dangerous for the user. The sewing machine 1 then controls the display to notify the user how seriously the sewing operation will be troubled. The sewing machine 1 performs this displaying operation before the user starts sewing.

In the present embodiment, after displaying the warning screen WS-C to cause the user to pay attention to the present status, if the present condition is maintained, the sewing machine 1 changes the warning screen WS-C into the higher level warning screen WS-D. Similarly, after displaying some warning screen WS to notify the user of the present status, if the user performs to deteriorate the status, the sewing machine 1 changes the present warning screen WS into another warning screen WS of a higher level. If the present status is somewhat improved, on the other hand, the sewing machine 1 may change the warning screen WS into another image screen WS of a lower level.

In the present embodiment, each symbol S represents the imaginary person's face. However, the symbol S may be designed in the figure of another animal, a plant, or a personificated object.

In the embodiment, the warning screen WS displays the symbol S as indicative of the danger level. However, in place of the symbol S, the warning screen WS may display a short message such as reading as "DANGER LEVEL 5" on the corresponding background color. Or, the warning screen WS may be combined with a plurality of LEDs. The sewing machine 1 may turn on some of the LEDs while displaying the warning screen WS. The number of the turned-on LEDs is changed together with the change in the background color of the warning screen WS, thereby notifying the user of the danger level. Also in this modification, the user can know the present condition visually and therefore immediately.

In the embodiment, all the symbols S-A through S-E are designed as expressions developed on the same imaginary person's face, that is, on the same object. However, those symbols S-A through S-E may be designed as different objects so that each symbol can indicate a corresponding danger level.

In the above-described embodiment, the warning screen WS is displayed as overlapped on the operation screen OS as shown in FIG. 5(*b*). However, the warning screen WS may not be displayed. The background color of the operation screen OS shown in FIG. 5(*a*) may be changed according to the danger level of the present condition.

Figure 12:
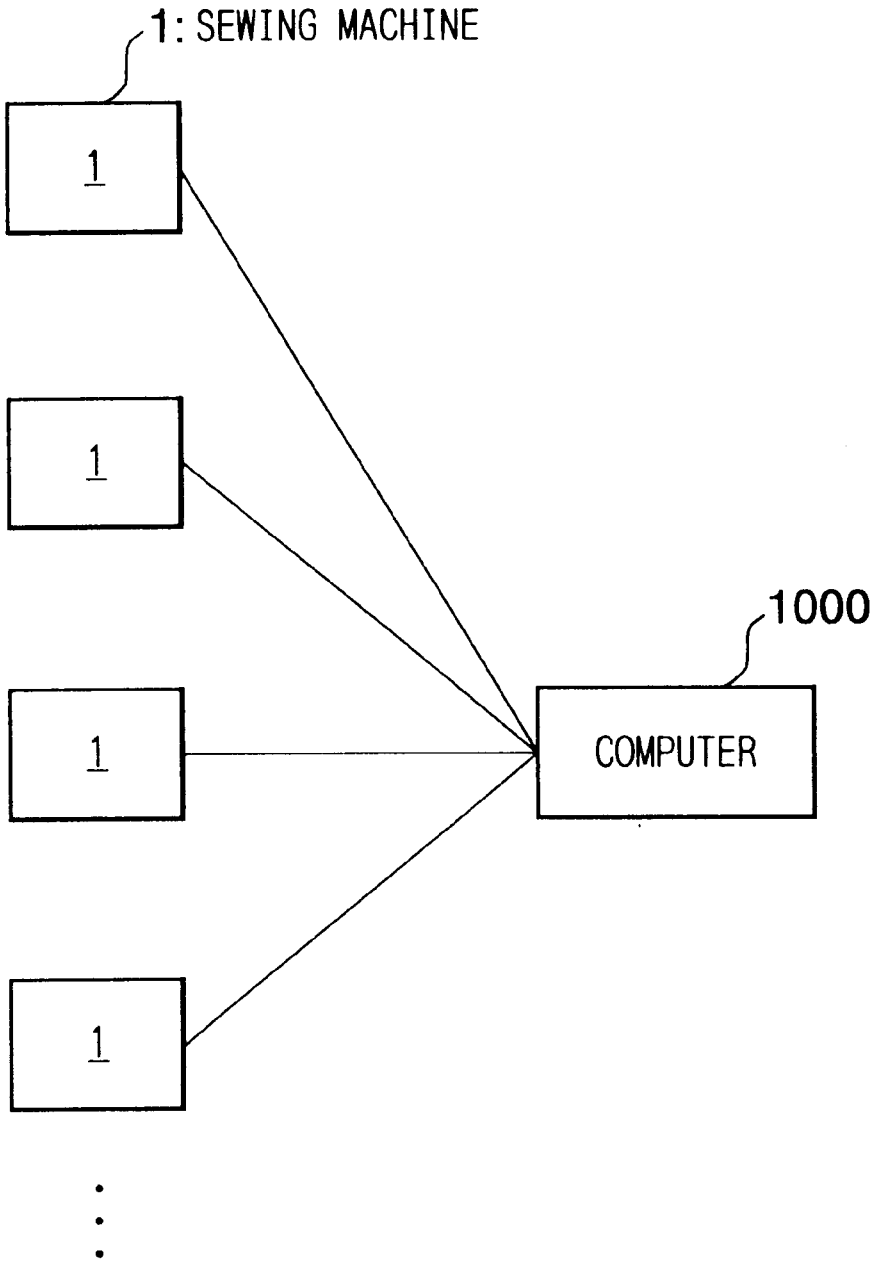
FIG. 12 is a block diagram of a sewing system where a plurality of sewing machines are included.

In the embodiment, the single sewing machine 1 is provided with the keys 19 and the LCD 12. However, the present invention can be applied to a sewing system or device shown in FIG. 12, in which a plurality of sewing machines 1 are connected to and controlled centrally by a single controller (computer) 1000. In this case, the computer 1000 controls sewing operation of each sewing machine 1 while receiving detection signals from each sewing machine 1. The computer 1000 displays on its display a plurality of warning screens WS of FIG. 5(*b*) each for a corresponding sewing machine 1. The user can therefore know, at the control portion 1000, the operational condition of each sewing machine 1.

In the embodiment, the touch panel 13 is of an analog type in which the keys 19 are designed so that the user's finger's touched position is detected as a position on some key 19 based on accumulation of changes in resistance on the entire touch panel 13 occurring due to the user's finger's pressing action. However, the touch panel 13 may be of a digital type in which the keys 19 are constructed from a plurality of separated transparent switches or buttons.

As described above, according to the present embodiment, the user can clearly confirm the present operational condition of the sewing machine 1. When the sewing machine 1 operates erroneously, the user can immediately and correctly know this erroneous state and can properly operate the sewing machine 1. The user can know how the present condition is dangerous based on the displayed dangerous level color. Because the symbol also changes according to the change in the displayed background color, the user can assuredly know the change in the operational condition.

While the invention has been described in detail with reference to the specific embodiment thereof, it would be apparent to those skilled in the art that various changes and modifications may be made therein without departing from the spirit of the invention.

What is claimed is:

1. A sewing device, comprising:

sewing means for performing a sewing operation;

color display means having a display screen for displaying a color image having a message and a symbol formed on a background region;

judging means for judging an operational state of the sewing means; and notification control means for controlling the color display means to change the message, the symbol, and a background color of the background region displayed thereon, thereby notifying a user of the judged operational state.

2. A sewing device as claimed in claim 1, wherein the judging means includes detection means for detecting an operational state of the sewing means, the notification control means controlling the color display means to change a color displayed thereon, thereby notifying a user of the detected operational state.

3. A sewing device as claimed in claim 2, wherein the color display means has a display screen for displaying the color image thereon, and wherein the notification control means controls the color display means to change a background color displayed on the display screen, thereby notifying the user of the detected operational state.

4. A sewing device as claimed in claim 2, wherein the detection means includes determination means for determining whether the detected operational state is either one of a predetermined plurality of different levels, further comprising storage means for storing data of a predetermined plurality of different colors in one to one correspondence with the plurality of levels, the notification control means controlling the color display means to display one color predetermined for the determined level, thereby notifying the user of the detected operational state.

5. A sewing device as claimed in claim 4, further comprising another storage means for storing data of a predetermined plurality of different symbols in one to one correspondence with the plurality of levels, the notification control means controlling the color display means to display a background color predetermined for the determined level and also to display a symbol predetermined for the determined level, thereby notifying the user of the detected operational state.

6. A sewing device as claimed in claim 4, wherein the plurality of different levels include at least first through third different levels which are defined according to a dangerous state of sewing operation so that the third level is the most dangerous.

7. A sewing device as claimed in claim 6, wherein the predetermined plurality of colors include yellow, orange, and red, which correspond to the first through third levels, respectively.

8. A sewing device as claimed in claim 1, wherein the color display means includes a liquid crystal display of a color type.

9. A sewing device as claimed in claim 2, wherein the sewing means includes one or more sewing machines for performing sewing operation; and sewing control means for controlling each of the one or more sewing machines to perform its sewing operation, wherein the detection means detects the operational state of each sewing machine, the notification control means controlling the color display means to change a color displayed thereon in accordance with the detected operation state of each sewing machine, thereby notifying a user of the detected operational state of each sewing machine.

10. A sewing machine, comprising:

a sewing unit that performs a sewing operation;

a color display having a display screen for displaying a color image having a message and a symbol formed on a background region;

a judging unit that judges an operational state of the sewing unit; and a notification controller that controls the color display to change the message, the symbol, and a background color of the background region displayed thereon, thereby notifying a user of the judged operational state.

11. A sewing device as claimed in claim 10, wherein the judging unit includes a sensor detecting an operational state of the sewing unit, the notification controller controlling the color display to change a color displayed thereon, thereby notifying a user of the detected operational state.

12. A sewing device as claimed in claim 11, wherein the color display has a display screen for displaying the color image thereon, and wherein the notification controller controls the color display to change a background color displayed on the display screen, thereby notifying the user of the detected operational state.

13. A sewing device as claimed in claim 11, wherein the sensor includes a determination unit determining whether the detected operational state is either one of a predetermined plurality of different levels, further comprising a memory storing data of a predetermined plurality of different colors in one to one correspondence with the plurality of levels, the notification controller controlling the color display to display one color predetermined for the determined level, thereby notifying the user of the detected operational state.

14. A sewing device as claimed in claim 13, further comprising another memory storing data of a predetermined plurality of different symbols in one to one correspondence with the plurality of levels, the notification controller controlling the color display to display a background color predetermined for the determined level and also to display a symbol predetermined for the determined level, thereby notifying the user of the detected operational state.

15. A sewing device as claimed in claim 13, wherein the plurality of different levels include at least first through third different levels which are defined according to a dangerous state of sewing operation so that the third level is the most dangerous.

16. A sewing device as claimed in claim 15, wherein the predetermined plurality of colors include yellow, orange, and red, which correspond to the first through third levels, respectively.

17. A sewing device as claimed in claim 10, wherein the color display includes a liquid crystal display of a color type.

18. A sewing device as claimed in claim 11, wherein the sewing unit includes one or more sewing machines for performing sewing operation; and a sewing controller for controlling each of the one or more sewing machines to perform its sewing operation, wherein the sensor detects the operational state of each sewing machine, the notification controller controlling the color display to change a color displayed thereon in accordance with the detected operation state of each sewing machine, thereby notifying a user of the detected operational state of each sewing machine.

19. A sewing device as claimed in claim 1, wherein the judging means includes determination means for determining whether the judged operational state is any one of a predetermined plurality of different levels, further comprising storage means for storing data of a predetermined plurality of different colors, data of a predetermined plurality of different symbols, and data of a predetermined plurality of different messages, data of each color, data of each symbol, and data of each message being stored in one to one correspondence with the plurality of levels, wherein the notification control means includes:

retrieving means for retrieving, from the storage means, data of a background color, data of a symbol, and data of a message, each of which is predetermined for the determined level; and control means for controlling, based on the retrieved data of the background color, of the symbol, and of the message, the color display means to display the background region with the background color predetermined for the determined level and to display, on the background region, the symbol and the message predetermined for the determined level on the background color, thereby notifying the user of the detected operational state.

20. A sewing device as claimed in claim 10, wherein the judging unit includes a determination unit that determines whether the judged operational state is one of a predetermined plurality of different levels, further comprising a memory storing data of a predetermined plurality of different colors, data of a predetermined plurality of different symbols, and data of a predetermined plurality of different messages, data of each color, data of each symbol, and data of each message being stored in one to one correspondence with the plurality of levels, wherein the notification controller includes:

a retrieving unit that receives, from the memory, data of a background color, data of a symbol, and data of a message, each of which is predetermined for the determined level; and a controller that controls, based on the retrieved data of the background color, of the symbol, and of the message, the color display to display the background region with the background color predetermined for the determined level and to display, on the background region, the symbol and the message predetermined for the determined level on the background color, thereby notifying the user of the detected operational state.

* * * * *